US006974119B2

(12) United States Patent
Brendle et al.

(10) Patent No.: US 6,974,119 B2
(45) Date of Patent: Dec. 13, 2005

(54) ACTUATOR

(75) Inventors: Matthias Brendle, Stuttgart (DE); Ralph Krause, Waiblingen (DE); Michael Runft, Rudersberg (DE)

(73) Assignee: Robert Bosch GmbH, Stuttgart (DE)

( * ) Notice: Subject to any disclaimer, the term of this patent is extended or adjusted under 35 U.S.C. 154(b) by 85 days.

(21) Appl. No.: 10/432,434

(22) PCT Filed: Sep. 26, 2002

(86) PCT No.: PCT/DE02/03658

§ 371 (c)(1),
(2), (4) Date: Nov. 10, 2003

(87) PCT Pub. No.: WO03/029632

PCT Pub. Date: Apr. 10, 2003

(65) Prior Publication Data

US 2004/0060349 A1 Apr. 1, 2004

(30) Foreign Application Priority Data

Sep. 27, 2001 (DE) ..... 101 47 736

(51) Int. Cl.[7] ..... F02D 9/02
(52) U.S. Cl. ..... 251/129.11; 251/305; 251/361; 123/399

(58) Field of Search ..... 251/129.11, 305, 251/361; 123/399

(56) References Cited

U.S. PATENT DOCUMENTS

| | | | | |
|---|---|---|---|---|
| 4,838,226 | A * | 6/1989 | Matsuzawa et al. | 123/399 |
| 5,672,818 | A | 9/1997 | Schaefer et al. | |
| 6,435,169 | B1 * | 8/2002 | Vogt | 123/568.23 |
| 2001/0048089 | A1 * | 12/2001 | Clark et al. | 251/129.11 |

FOREIGN PATENT DOCUMENTS

| | | |
|---|---|---|
| EP | 0 290 980 A2 | 11/1988 |
| JP | 62-129533 | 6/1987 |

* cited by examiner

*Primary Examiner*—J. Casimer Jacyna
(74) *Attorney, Agent, or Firm*—Ronald E. Greigg

(57) ABSTRACT

An actuator unit including a step-up which varies over an adjustment path, between a control motor and a wheel connected to the throttle body in a manner fixed against relative rotation offers the advantage that in certain positions of the throttle body, the required increased torque can also be brought to bear by a relatively low-torque control motor. The actuator unit is intended in particular for internal combustion engines for motor vehicles.

20 Claims, 4 Drawing Sheets

ACTUATOR

CROSS-REFERENCE TO RELATED APPLICATIONS

This application is a 35 USC 371 application of PCT/DE 02/03658 filed on Sep. 26, 2002.

BACKGROUND OF THE INVENTION

1. Field of the Invention

The invention is directed to an improved actuator unit for controlling movement of a throttle body.

2. Description of the Prior Art

German Published, Nonexamined Patent Application DE-A 195 25 510 and U.S. Pat. No. 5,672,818 show an actuator unit with a control motor and a throttle body. In the known actuator unit, between the control motor and the throttle body, which takes the form of a throttle valve, there is always the same gear ratio in every position. As is now known, the torque required at the throttle body is of various magnitudes in the various positions of the throttle body. For this reason, the torque of the control motor must be designed to be high enough that this torque suffices in every position of the throttle body. The control motor must also be designed such that in all the adjustment ranges, the throttle valve can be adjusted fast enough. Both requirements necessitate a powerful and thus relatively large, expensive control motor. This makes the overall actuator unit relatively large and requires a relatively large amount of installation space.

SUMMARY OF THE INVENTION

The actuator unit of the invention offers the advantage over the prior art that for adjusting the throttle body, a relatively low-power and thus small control motor that can be produced at low cost or procured economically suffices. It is especially advantageous that a relatively small maximum torque of the control motor suffices, and that the control motor can adjust the throttle body especially fast in those ranges in which that is necessary. As a result, a control motor that is simple to produce and small in size can be used.

In the actuator unit of the invention, there is advantageously a step-up, which varies over the adjustment path, between the control motor and the wheel connected to the throttle body in a manner fixed against relative rotation. This offers the advantage that the increased torque required in certain positions of the throttle body can also be brought to bear by a relatively low-torque control motor.

By means of the provisions recited in the dependent claims, advantageous refinements of and improvements to the actuator unit of claim 1 are possible.

It is understood that the control motor must be designed such that its torque suffices to be able to adjust the throttle body. However, it has been demonstrated that for adjusting the throttle body, the same torque is not required at every positional angle of the throttle body. The step-up proposed here between the control motor and the throttle body can be designed such that the control motor can provide adjustment over the entire adjustment range with practically constant torque, and nevertheless, advantageously, whatever different torque is required in each position of the throttle body in fact acts on the throttle body. Because of flow conditions and/or varying friction and/or the necessity of tearing the throttle body away in a closing position, an especially high torque is often required for adjusting the throttle body into or from the closing position. Because of the varying step-up, in the actuator unit proposed, between the control motor and the throttle body upon adjustment of the throttle body over the entire adjustment range, a markedly increased torque at the throttle body results in the region of the closing position. This torque is in particular markedly higher than when a speed-increasing gear with a constant step-up is used, as in the version shown in DE-A 195 25 510. In the version proposed here, a smaller control motor can therefore be used than in the known actuator unit.

Because of the increased torque at the throttle body, any deposits that may occur in the conduit can also easily be overcome in the region of the closing position.

In a middle range, it is desirable that the control motor be able to adjust the throttle body fairly fast. Since the proposed speed-increasing gear is selected such that in the middle of the adjustment range, for a given rpm of the drive shaft of the control motor, the throttle body is adjusted fairly fast, a control motor with a relatively slowly rotating drive shaft is advantageously sufficient.

Because of the various step-ups between the control motor and the throttle body, which are selected such that in the region of the closing position, for a given rpm of the drive shaft of the control motor, the throttle body is adjusted only relatively slowly, the advantage is obtained that in the region of the closing position, a very sensitive adjustment of the throttle body is possible.

Because in the fast-adjustment range the throttle body can be adjusted very fast, the overall result obtained is an advantageously short adjusting time upon adjustment of the throttle body between the two terminal positions.

Since the step-up need not be of the same magnitude throughout the entire adjustment range, the speed-increasing gear of the actuator unit is structurally especially small.

If the step-up is selected such that, in the range in which the restoring device generates an especially high restoring torque, the step-up is increased somewhat, the result is the advantage that despite the increased restoring torque of the restoring device, the control motor can adjust the throttle body with a fairly constant torque.

Because the rolling curve radius associated with the throttle body is longer at every engagement point than the rolling curve radius associated with the control motor, the advantage is obtained that in every pivoting position an additional step-up exists, so that with a minimum of gear stages, an overall adequate step-up is attained, and that as a result, advantageously, a control motor of fairly small structure can be used, and that the total expense for the actuator unit is fairly low.

DESCRIPTION OF THE PREFERRED EMBODIMENT

The actuator unit can be used in any internal combustion engine in which the power of the engine is to be varied with the aid of a throttle body that is adjustable by means of a control motor. The throttle body is for instance a throttle valve, and the actuator unit with the throttle body or throttle valve is used for instance for controlling the air supplied to an internal combustion engine. It is also possible, however, for the actuator unit to be used in the region of the exhaust gas of the engine, for controlling the flow of exhaust gas, or the actuator unit is used for instance for directing flowing exhaust gas into the fresh-air line of the engine.

Figure 1:
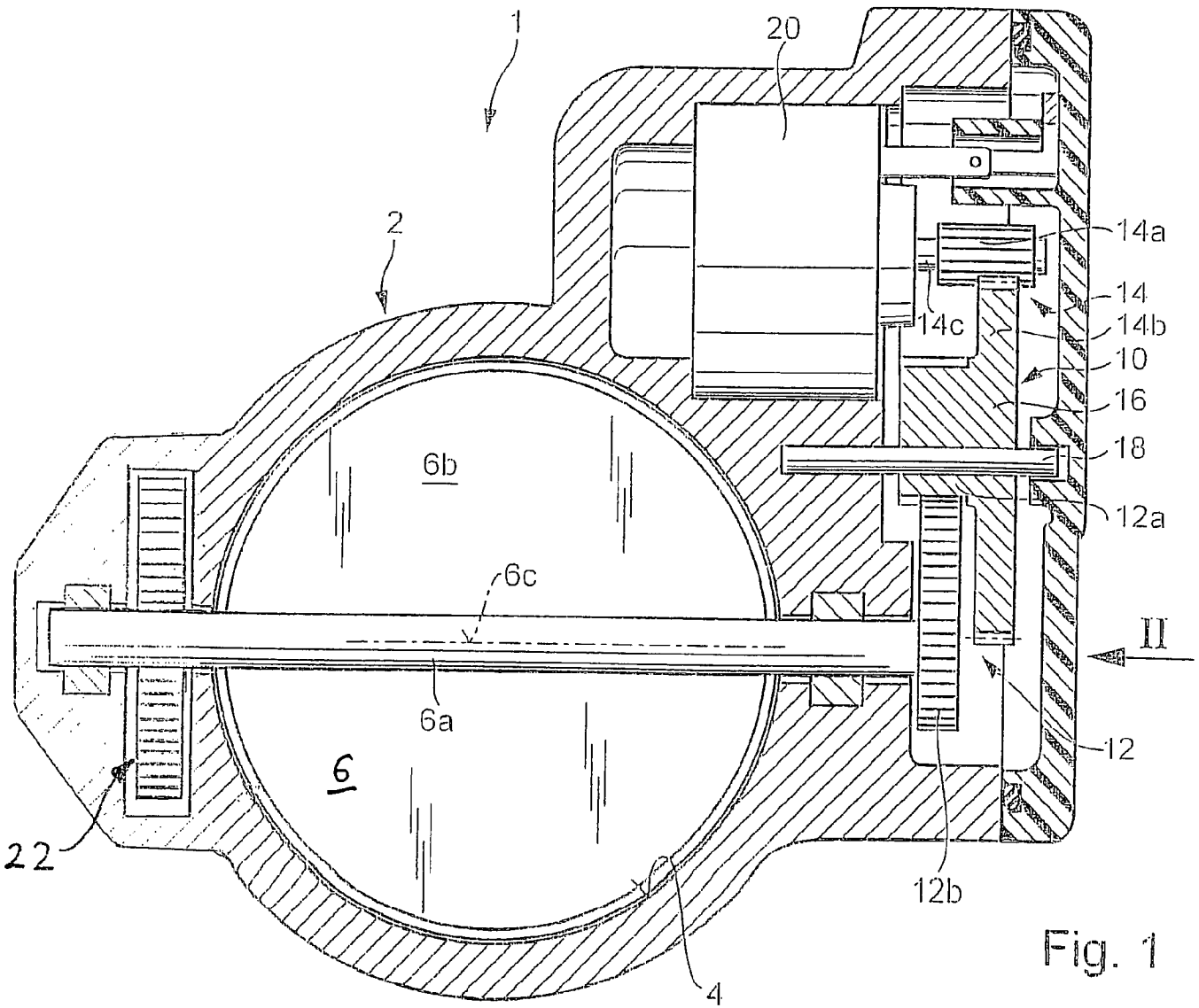
FIG. 1 shows a cross section through the actuator unit of the invention.

FIG. 1 shows an actuator unit 1 with an actuator housing 2. Depending on the use of the actuator unit 1, the actuator housing 2 is for instance called a throttle valve stub or an exhaust gas recirculation valve. A conduit 4 extends through the actuator housing 2, or throttle valve stub. For instance, the conduit 4 leads from an air filter, not shown, to a combustion chamber or multiple combustion chambers, also not shown, of an internal combustion engine, not shown. The good properties attainable with the proposed actuator housing 2 make the actuator housing 2 especially well suited for use as an exhaust gas recirculation valve. The proportion of exhaust gas delivered to the fresh air, for instance, is controlled with the exhaust gas recirculation valve.

The section shown in FIG. 1 extends transversely through the conduit 4. Fresh incoming air or a fuel-air mixture or exhaust gas or some of the exhaust gas can for instance flow through the conduit 4 either toward or away from an engine.

In the actuator housing 2, a throttle body 6 is supported rotatably or pivotably. In the exemplary embodiment shown, the throttle body 6 is formed by a throttle valve 6*b* that is secured to a throttle valve shaft 6*a*. The throttle valve shaft 6*a* extends transversely through the conduit 4. The throttle valve shaft 6*a* is pivotably supported in the actuator housing 2. The throttle valve 6*b* is secured to the throttle valve shaft 6*a* by fastening screws, not shown. However, instead, the throttle valve 6*b* and the throttle valve shaft 6*a* can be cast together, integrally, from plastic. The throttle valve shaft can be pivoted between a first terminal position S1 and a second terminal position S2. The throttle body 6, or in the exemplary embodiment shown the throttle valve 6*b* together with the throttle valve shaft 6*a*, is pivotable or rotatable about a pivot axis 6*c* by a throttle valve positioning angle $\alpha$ (alpha).

Outside the conduit 4, there is a speed-increasing gear 10 assembly. The speed-increasing gear assembly 10 has one pair of wheels 12 and a second pair of wheels 14. The pair of wheels 12 has one wheel 12*a* associated with the control motor and one wheel 12*b* associated with the throttle body. The second pair of wheels 14 comprises a pinion 14*a* and an intermediate wheel 14*b*. The wheel 12*a* associated with the control motor and the intermediate wheel 14*b* are rigidly joined to one another and form a gear wheel 16 of the speed-increasing gear 10. A shaft 18 is fixedly mounted on the actuator housing 2. The gear wheel 16 is supported rotatably on the shaft 18.

The pinion 14*a* is connected to a drive shaft 14*c* of a control motor 20 in a manner fixed against relative rotation. The control motor 20 is firmly anchored to the actuator housing 2.

The wheel 12*b* associated with the throttle body is connected to the throttle valve shaft 6*a* in a manner fixed against relative rotation. The wheel 12*b* associated with the throttle body is in constant engagement with the wheel 12*a* associated with the control motor. The pinion 14*a* of the control motor 20 meshes with the intermediate wheel 14*b*.

The actuator unit 1 has a restoring device 22. The restoring device 22 assures that when the control motor 20 is without current, the throttle body 6 is pivoted back into the first terminal position, for instance, which is equivalent to the closing position S1.

Figure 2:
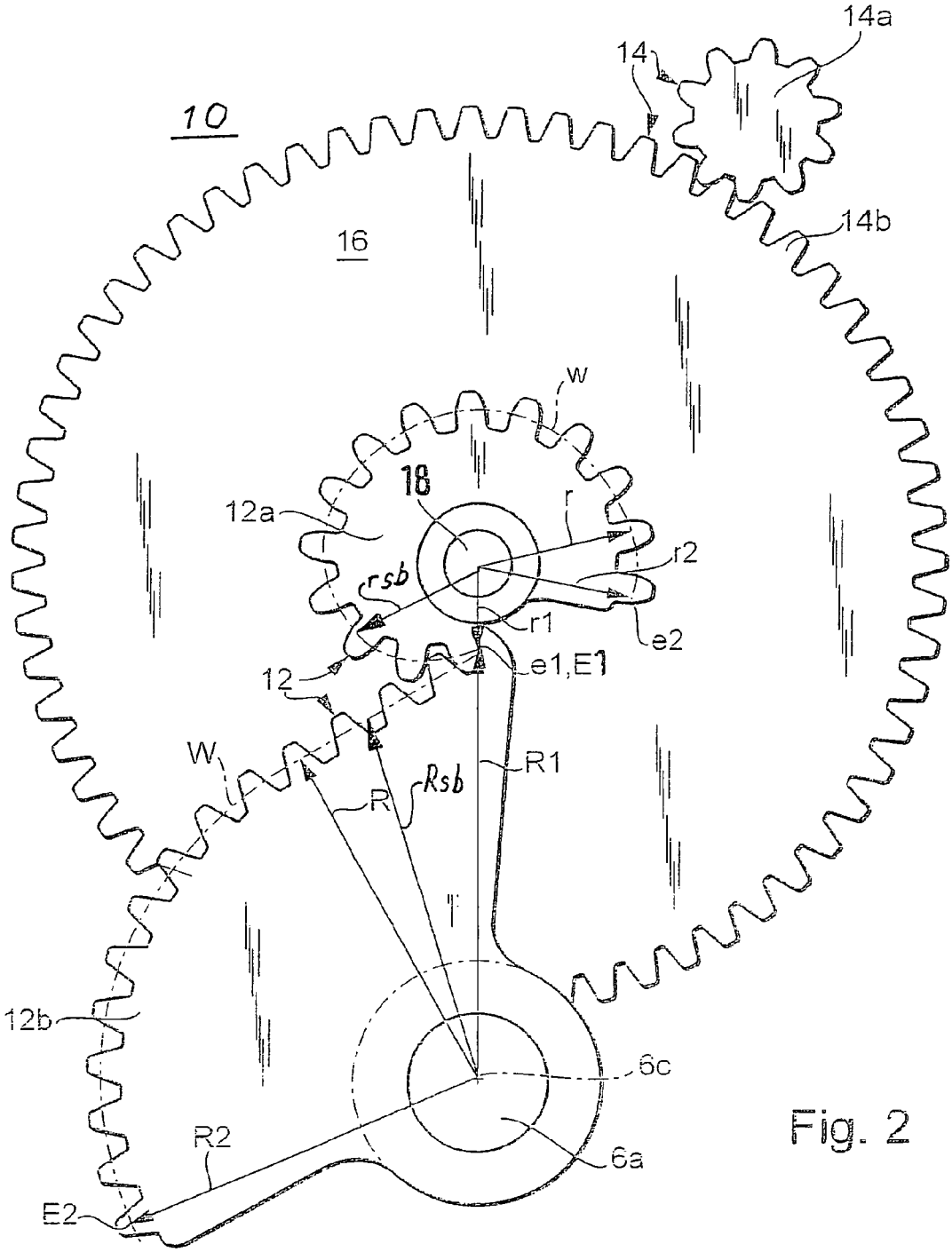
FIG. 2 shows the speed-increasing gear while the wheels are in the closing position.
Figure 3:
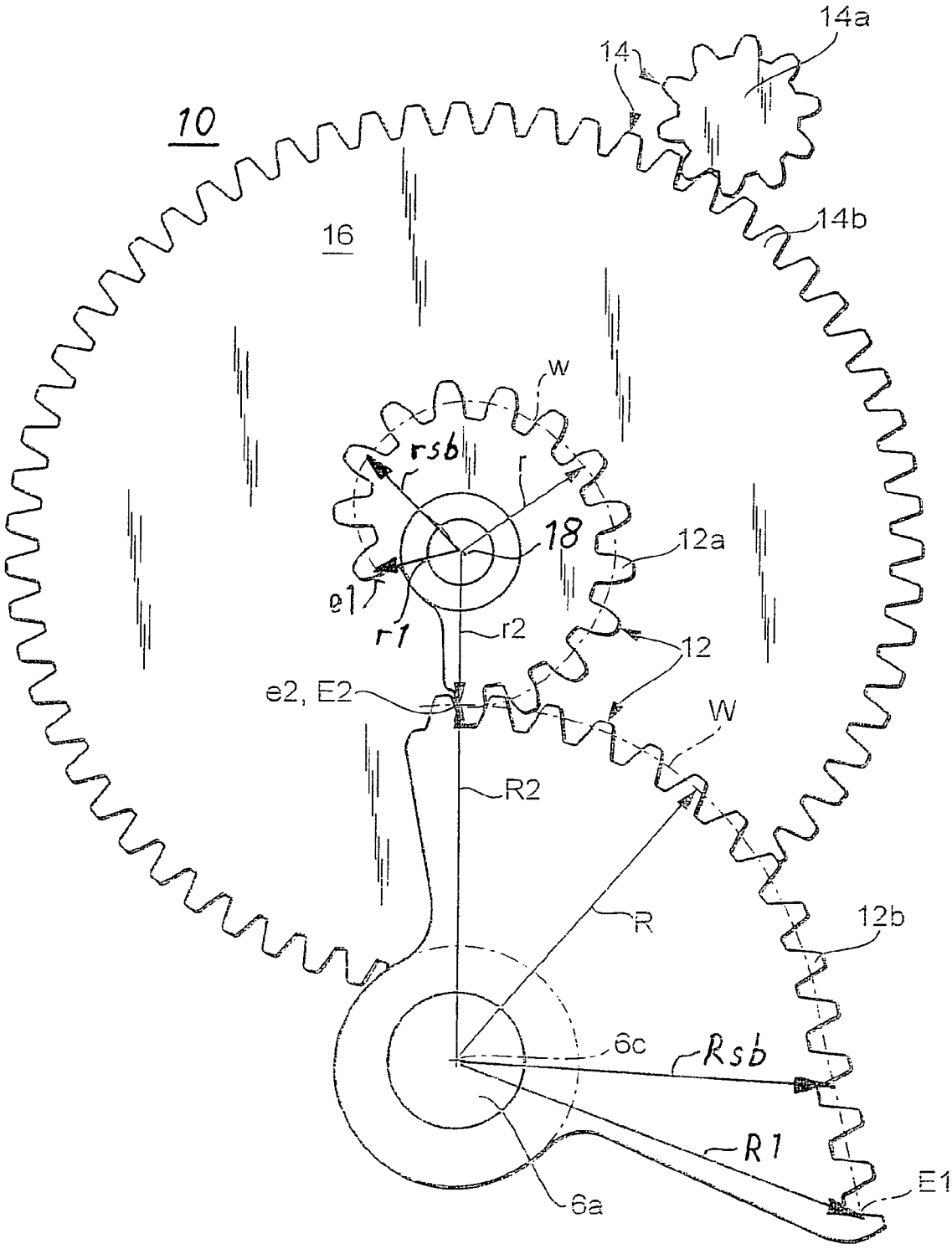
FIG. 3 shows the speed-increasing gear while the wheels are in an open position.

FIGS. 2 and 3 show a view of the speed-increasing gear 10 in the same direction as indicated by the arrow II in FIG. 1. In FIGS. 2 and 3, for the sake of greater clarity, the actuator housing 2 and throttle valve 6*b* are not shown.

Figure 4:
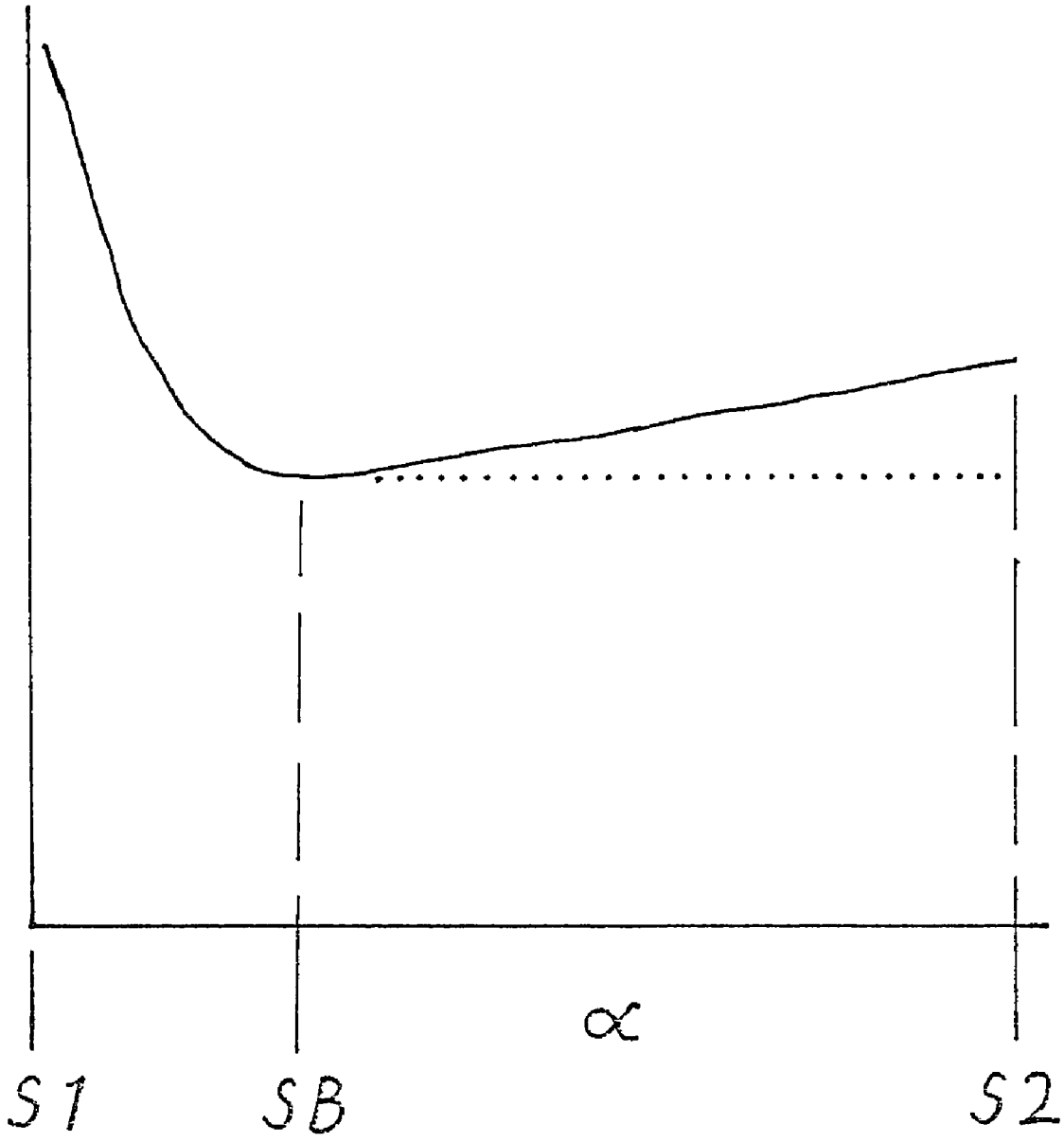
FIG. 4 shows the step-up as a function of the adjustment angle of the throttle body.

FIG. 4 shows the step-up i of the speed-increasing gear 10 as a function of the throttle valve positioning angle $\alpha$ (alpha). The throttle valve positioning angle $\alpha$ is plotted on the abscissa, and the step-up i is plotted on the ordinate.

In all the drawings, identical parts or parts functioning the same are identified by the same reference numerals.

The throttle body 6 is adjustable between a first terminal position S1 and a second terminal position S2. In the first terminal position S1 (FIG. 2), the throttle body 6 extensively or completely or nearly completely closes the conduit 4, or, in the first terminal position S1, the conduit 4 is for instance opened somewhat to allow emergency operation. The first terminal position S1 will hereinafter be called the closing position S1. In the second terminal position S2 (FIG. 3) of the pivoting range of the throttle body 6, the conduit 4 is maximally open. The second terminal position S2 will hereinafter be called the open position S2. An approximately middle region between the closing position S1 and the open position S2 will hereinafter be called the fast-adjustment range SB (FIG. 4).

FIG. 2 shows the speed-increasing gear 10 in the closing position S1, and FIG. 3 shows the speed-increasing gear 10 in the open position S2.

In the preferably selected embodiment shown as an example in FIGS. 2 and 3, the throttle body 6 and thus the wheel 12*b* associated with the throttle body, which is connected to the throttle body 6 in a manner fixed against relative rotation, is pivotable by 110°. The adjustment range shown in FIG. 4 between the closing position S1 and the open position S2 of the throttle valve positioning angle would then also amount to 110°.

It is in particular also usual for the throttle body 6 to be pivotable for instance by 90°, or by less than 90°. Then the adjustment range of the throttle valve positioning angle $\alpha$ would thus be 90° or less than 90°. However, embodiments also exist in which the throttle body 6 is pivoted by only 85°. Embodiments also exist in which the throttle body 6 is pivotable past the closing position or past the open position, for instance by a total of up to 115°. There are also actuator units, particularly in the form of an exhaust gas recirculation valve, in which the throttle body 6 is pivotable for instance by the adjustment range of 136° between the closing position S1 and the open position S2. This is the case particularly whenever the actuator unit 1 is an exhaust gas recirculation valve, and the throttle body 6 is positioned obliquely to the pivot axis 6*c* at an acute angle. The adjustment range shown in FIG. 4 for the throttle valve positioning angle $\alpha$ can thus amount to 85°, 90°, 110°, 115°, or 136°, for instance, to name only some figures.

The throttle body 6 and thus also the wheel 12*b* associated with the throttle body are adjustable between the closing position S1 and the open position S2. FIG. 2 shows the wheel 12*b* associated with the throttle body and the intermediate wheel 14*b*, mounted on the gear wheel 16, in the first terminal position S1, and FIG. 3 shows the speed-increasing gear 10 while the rotating parts are in the second terminal position S2. The rotating parts are adjustable between these terminal positions S1 and S2. In the explanations below of the particularly advantageous exemplary embodiment, it has been assumed that in the first terminal position S1 (FIG. 2), the throttle body 6 closes the conduit 4, and in the second terminal position S2 (FIG. 3), the throttle body 6 opens the conduit 4.

The wheel 12*a* associated with the control motor has a first engagement end e1 and a second engagement end e2. The wheel 12*b* associated with the throttle body has a first engagement end E1 and a second engagement end E2.

When the speed-increasing gear 10 is in the closing position S1 (FIG. 2), the first engagement end e1 of the wheel 12*a* associated with the control motor is then in engagement with the first engagement end E1 of the wheel 12*b* associated with the throttle body. When the speed-increasing gear 10 is in the open position S2 (FIG. 3), the two second engagement ends e2 and E2 of the wheel 12*a* associated with the control motor and the wheel 12*b* associated with the throttle body are in engagement with one another.

The wheel 12*a* associated with the control motor, between its engagement ends e1 and e2, has a rolling curve w associated with the control motor. The wheel 12*b* associated with the throttle body, between its two engagement ends E1 and E2, has a rolling curve W associated with the throttle body. The rolling curve w associated with the control motor has a spacing from the pivot axis of the wheel 12*a* associated with the control motor that varies as a function of the angle and is hereinafter called the rolling curve radius r associated with the control motor. The rolling curve W associated with the throttle body has a spacing from the pivot axis 6*c* that varies as a function of the angle and is hereinafter called the rolling curve radius R associated with the throttle body. The rolling curve w associated with the control motor has a rolling curve radius r1 associated with the control motor on the first engagement end e1 and a rolling curve radius r2 associated with the control motor on the second engagement end e2. The wheel 12*b* associated with the throttle body has a rolling curve radius R1 associated with the throttle body on the first engagement end E1 and a rolling curve radius R2 associated with the throttle body on the second engagement end E2.

Between the closing position S1 and the open position S2 of the wheels 12*a*, 12*b*, there is a region in which upon actuation of the pinion 14*a* of the control motor 20 about a certain angle, the throttle body 6 is adjusted especially fast by a relatively large angle. This angular range will be called the fast-adjustment range SB here. The rolling curve w associated with the control motor has a rolling curve radius rsb associated with the control motor in the fast-adjustment range SB. The wheel 12*b* associated with the throttle body has a rolling curve radius Rsb associated with the throttle body in the fast-adjustment range SB.

In the wheel 12*a* associated with the control motor, the rolling curve radius rsb associated with the control motor is the longest in the fast-adjustment range SB. The wheel 12*a* associated with the control motor is designed such that the rolling curve radius r, beginning at the fast-adjustment range SB, becomes markedly shorter toward the first engagement end e1. Toward the second engagement end e2 as well, the rolling curve radius r associated with the control motor becomes smaller. The rolling curve radius R associated with the throttle body behaves in complementary fashion to the rolling curve radius r associated with the control motor.

In the so-called fast-adjustment range SB, the rolling curve radius r of the wheel 12*a* associated with the control motor is longest, while the rolling curve radius r decreases toward the engagement ends E1 and E2. Beginning at the fast-adjustment range SB, the rolling curve radius r decreases more sharply toward the first engagement end E1 than toward the second engagement end E2. The rolling curve radius r2 associated with the control motor at the second engagement end E2 is for instance 1.9 times as long as the rolling curve radius r2 associated with the control motor at the first engagement end E1.

The rolling curve W associated with the throttle body is designed such that the rolling curve radius R associated with the throttle body, beginning at the first engagement end E1, first becomes shorter toward the second engagement end E2; the rolling curve radius R associated with the throttle body is shortest in the region of the fast-adjustment range SB and then becomes longer again toward the second engagement end E2. The rolling curve radius R1 associated with the throttle body at the first engagement end E1 is for instance 1.2 times as long as the rolling curve radius R2 associated with the throttle body at the second engagement end E2.

The spacing between the pivot axis of the wheel 12*a* associated with the control motor and the pivot axis 6*c* of the wheel 12*b* is constant. The rolling curve radius r associated with the control motor and the rolling curve radius R associated with the throttle body are adapted to one another such that in every position of engagement between the two wheels 12*a* and 12*b*, the sum of the rolling curve radius r associated with the control motor and the rolling curve radius R associated with the throttle body is constant. In every position of the wheels 12*a*, 12*b*, the rolling curve radius r associated with the control motor is complementary to the rolling curve radius R associated with the throttle body.

The two rolling curves W and w are preferably adapted to one another such that in every position of engagement between the two wheels 12*a* and 12*b*, the rolling curve radius R associated with the throttle body is always longer than the rolling curve radius r associated with the control motor. The rolling curve radii R and r are adapted to one another for instance such that upon an adjustment of the speed-increasing gear 10 between the closing position S1 (FIG. 2) and the open position S2 (FIG. 3), on average there is a gear ratio of 3 to 1 between the two wheels 12*a* and 12*b*. This means that for instance for a required adjustment range of the throttle valve positioning angle $\alpha$ of the throttle body 6 between the two terminal positions S1 and S2 of 90°, the wheel 12*b* associated with the throttle body will rotate 90°, and the wheel 12*a* associated with the control motor will rotate 270°.

Since the rolling curve radius R associated with the throttle body is substantially longer than the rolling curve radius r associated with the control motor, the result obtained, beginning at the wheel 12*a* associated with the control motor and extending in the direction of the wheel 12*b* associated with the throttle body, is a desired reduction in the rotary speed and a desired increase in the torque.

Since the rolling curve radius R1 associated with the throttle body is especially long at the first engagement end E1, the result obtained in the region of the closing position S1 (FIG. 2) of the speed-increasing gear 10, beginning at the wheel 12*a* associated with the control motor and extending in the direction of the wheel 12*b* associated with the throttle body, is an especially great reduction in the angular velocity and an especially great increase in the torque. This offers the advantage that in the region of the closing position S1 (FIG. 2), an especially, precise adjustment of the throttle body 6 is possible, and any interfering forces that may be operative at the throttle body 6 can also be overcome easily with a relatively small, relatively weak control motor 20.

Since the reduction in the angular velocity from the wheel 12*a* associated with the control motor to the wheel 12*b* associated with the throttle body in the fast-adjustment range SB is less than in the closing position S1 (FIG. 2) and is also less than in the open position S2 (FIG. 3), the advantage is obtained that in the fast-adjustment range SB, the throttle body 6 can be adjusted very fast with a high angular velocity.

When the wheels 12*a*, 12*b* are in the open position S2 (FIG. 3) as well, the step-up between the wheel 12*a* associated with the control motor and the wheel 12*b* associated with the throttle body is still greater than in the fast-adjustment range SB, and the course of the step-up i shown in a solid line in FIG. 4 is obtained.

FIG. 4, with a solid line, shows the graph of one example of the step-up i in which the dependency of the step-up i on the throttle valve positioning angle α is especially favorable. A dotted line represents an equally possible course of the step-up i of a modified exemplary embodiment.

In the graph (FIG. 4), the step-up i when the throttle body 6 is located in the region of the closing position S1 is shown on the left. On the right in the graph, the step-up i when the throttle body 6 is in the region of the open position S2 is plotted. Between the two terminal positions S1 and S2 is the fast-adjustment range SB; in terms of angle, the fast-adjustment range SB is provided somewhat closer to the closing position S1 than to the open position S2.

As FIG. 4 shows, the step-up i is at its least at the point of the fast-adjustment range SB. The effect of this is that the control motor 20, with little rotation of the pinion 14*a*, can adjust the throttle body 6 by a relatively large angle. Since in the fast-adjustment range SB the throttle body 6 can be adjusted quickly, the total adjusting time between the two terminal positions S1 and S2 is relatively short.

In the region of the closing position S1, as FIG. 4 shows, the step-up i is fairly great. This means that a control motor 20 with relatively low torque is also capable of adjusting the throttle body 6, even if in the region of the closing position S1 there is more or less friction between the throttle body 6 and the conduit 4. Because of the great step-up i, it is possible to provide only little play between the throttle body 6 and the conduit 4, and with certain terminals, the throttle body 6 can be adjusted using a relatively low-torque control motor 20.

Typically, the actuator unit 1 is embodied such that the control motor 20 adjusts the throttle body 6 in the direction of the open position S2 (FIG. 3) counter to the force of the restoring device 22. When the control motor 20 is inactive, the restoring device 22 returns the throttle body 6 to the closing position S1 (FIG. 2).

The restoring device 22 typically comprises a spring, and with increasing adjustment of the throttle body 6 into the open position S2, the force or torque of the spring of the restoring device 22 becomes greater. In order for the requisite torque of the control motor 20 for adjusting the throttle body 6 counter to the force of the restoring device 22 between the fast-adjustment range SB and the second terminal position S2 to remain substantially constant, it is provided that the step-up i, beginning at the fast-adjustment range SB, increases slightly in the direction of the open position S2, as shown by the solid line in FIG. 2.

Because it is appropriate to make the step-up at the second pair of wheels 14, between the pinion 14*a* and the intermediate wheel 14*b*, or in other words in the first gear stage, arbitrarily great, and because in the actuator unit 1 proposed here there is also a step-up in the pair of wheels 12, between the wheel 12*a* associated with the control motor and the wheel 12*b* associated with the throttle body, an especially great total step-up between the control motor 20 and the throttle body 6 is advantageously obtained nevertheless. As a result, even with a relatively small, high-speed control motor 20, a precise adjustment of the throttle body 6 is possible, and even a relatively small control motor 20 is easily capable of overcoming the forces that occur at the throttle body 6.

The maximum step-up i at the pair of wheels 12 between the wheels 12*a* and 12*b* can, as a function of the required adjustment range of the throttle valve positioning angle α, achieve values markedly greater than 1. The attainable average step-up i at the pair of wheels 12 is 360°, divided by the required adjustment range of the throttle valve positioning angle α in degrees. Since the wheels 12*a* and 12*b* can also serve both to step up the torque and to reduce the rpm, an additional step-up stage between the control motor 20 and the throttle body 6 can optionally be omitted.

For reasons of space, the maximum pivot angle of the wheel 12*a* associated with the control motor must amount to less than 360°. As a result, the step-up i at the pair of wheels 12 is limited for instance to at most 4 to 1, if the throttle body 6 is to be adjustable by 90°. In the propose actuator unit, the step-up i varies as a function of the angle. Wherever a great step-up i is advantageous, the step-up i is greater than in regions where not such a great step-up i is needed. As a result, in the regions where a great step-up i is required, a value amounting to substantially more than 4 to 1 is attained, even if the step-up i at the pair of wheels 12 on average must not be allowed to exceed the maximum possible value, for instance of 4 to 1.

The exemplary embodiment can also be modified such that the rolling curve radius R associated with the throttle body, in the region of the second engagement end E2, between the fast-adjustment range SB and the second engagement end E2, is constant over approximately half the adjustment angle of the wheel 12*b* associated with the throttle body. Correspondingly, the rolling curve radius r associated with the control motor, adjoining the second engagement end e2, between the fast-adjustment range SB and the second engagement end e2, is also constant. In other words, in the region of the second engagement ends e2 and E2, for the wheels 12*a* and 12*b*, the rolling curves w and W are each circular arcs. As a result, in this modification of the exemplary embodiment, the course of the step-up i shown in a dotted line in FIG. 4 is obtained.

In the region of the first engagement end E1, between the fast-adjustment range SB and the engagement end E1, the rolling curve W associated with the throttle body is, in approximate terms, a straight line, which adjoins the rolling curve W, located in the fast-adjustment range SB, at a tangent. As a result, the rolling curve radius R associated with the throttle body, in the region of the first engagement end E1, increases sharply in the direction of the first engagement end E1. Correspondingly, the rolling curve radius r associated with the control motor decreases sharply toward the first engagement end e1. This offers the desired advantage that in the region of the first engagement ends e1, E1, that is, in the closing position S1 (FIG. 2), the torque step-up from the wheel 12*a* associated with the control motor to the wheel 12*b* associated with the throttle body is greatly increased.

In the preferably selected, especially advantageous exemplary embodiment shown, the wheels 12*a*, 12*b*, 14*a* and 14*b* are gear wheels that mesh with one another. However, it is also conceivable instead of gear wheels, to use toothless friction wheels, for instance, which have surfaces with a very high coefficient of friction, so that the torque is transmitted via frictional force between the wheels meshing with one another.

In the preferably selected, especially advantageous exemplary embodiment shown, the speed-increasing gear 10 is a two-stage gear. However, it is also conceivable for the second pair of wheels 14, formed of the pinion 14*a* and the intermediate wheel 14*b*, to be omitted. In that case, it is appropriate for the drive shaft 14*c* of the control motor 20 to engage the wheel 12*a* associated with the control motor directly, without an intervening step-up.

The foregoing relates to preferred exemplary embodiments of the invention, it being understood that other variants and embodiments thereof are possible within the spirit and scope of the invention, the latter being defined by the appended claims.

We claim:

1. An actuator unit, comprising an actuator housing (2);

a conduit (4) in the actuator housing (2), a throttle body (6, 6*a*, 6*b*), supported rotatably in the actuator housing (2) and adjustable over an adjustment range, for controlling a free cross section in the conduit (4);

a control motor (20) with a drive shaft (14*c*) having a pinion gear (14*a*) mounted thereon for adjusting the throttle body (6, 6*a*, 6*b*);

the pinion gear (14*a*) engaging an intermediate wheel (14*b*) of a speed-increasing gear (10, 12, 12*a*, 12*b*, 14*b*) for converting an adjustment motion of the drive shaft (14*c*) to an adjustment motion of the throttle body (6, 6*a*, 6*b*), the speed-increasing gear (10, 12, 12*a*, 12*b*) having at least one pair of wheels (12, 12*a*, 12*b*), including one wheel (12*a*) associated with the control motor and one wheel (12*b*) associated with the throttle body, the wheel (12*a*) associated with the control motor and the wheel (12*b*) associated with the throttle body, upon adjustment of the throttle body (6, 6*a*, 6*b*) over the adjustment range are in engagement with one another each between a first engagement end (e1, E1) and a second engagement end (e2, E2), the wheel (12*a*) associated with the control motor, between its first engagement end (e1) and its second engagement end (e2), having a varying rolling curve radius (r) associated with the control motor; and the wheel (12*b*) associated with the throttle body, between its first engagement end (e1) and its second engagement end (e2), having a rolling curve radius (R) associated with the throttle body that varies in complementary fashion to the rolling curve radius (r) associated with the control motor.

2. The actuator unit of claim 1, wherein the free cross section in the conduit (4) is substantially closed when the wheels (12*a*, 12*b*) are in engagement with one another in the region of the first engagement ends (e1, E1).

3. The actuator unit of claim 1, wherein within the adjustment range, between the first engagement ends (e1, E1) and the second engagement ends (e2, E2), there is a fast-adjustment range (SB); and wherein the rolling curve radius (r) associated with the control motor is shorter in the region of the first engagement end (e1) than in the fast-adjustment range (SB).

4. The actuator unit of claim 1, wherein the free cross section in the conduit (4) is substantially closed when the wheels (12*a*, 12*b*) are in engagement with one another in the region of the first engagement ends (e1, E1); wherein within the adjustment range, between the first engagement ends (e1, E1) and the second engagement ends (e2, E2), there is a fast-adjustment range (SB); and that the rolling curve radius (r) associated with the control motor is shorter in the region of the first engagement end (e1) than in the fast-adjustment range (SB).

5. The actuator unit of claim 4, wherein the rolling curve radius (r) associated with the control motor is shorter in the region of the second engagement end (e2) than in the fast-adjustment range (SB).

6. The actuator unit of claim 1, wherein the free cross section in the conduit (4) is substantially closed when the wheels (12*a*, 12*b*) are in engagement with one another in the region of the first engagement ends (e1, E1); wherein within the adjustment range, between the first engagement ends (e1, E1) and the second engagement ends (e2, E2), there is a fast-adjustment range (SB); and wherein the rolling curve radius (r) associated with the control motor is longer in the fast-adjustment range (SB) than in the region of the first engagement end (e1) and is also longer than in the region of the second engagement end (e2).

7. The actuator unit of claim 1, wherein the rolling curve radius (r) associated with the control motor is shorter on its first engagement end (e1) than on its second engagement end (e2).

8. The actuator unit of claim 4, wherein the rolling curve radius (r) associated with the control motor is shorter on its first engagement end (e1) than on its second engagement end (e2).

9. The actuator unit of claim 5, wherein the rolling curve radius (r) associated with the control motor is shorter on its first engagement end (e1) than on its second engagement end (e2).

10. The actuator unit of claim 6, wherein the rolling curve radius (r) associated with the control motor is shorter on its first engagement end (e1) than on its second engagement end (e2).

11. The actuator unit of claim 1, wherein the wheel (12*a*) associated with the control motor is a gear wheel associated with the control motor, and the wheel (12*b*) associated with the throttle body is a gear wheel associated with the throttle body, and the gear wheel associated with the control motor meshes with the gear wheel associated with the throttle body.

12. The actuator unit of claim 2, wherein the wheel (12*a*) associated with the control motor is a gear wheel associated with the control motor, and the wheel (12*b*) associated with the throttle body is a gear wheel associated with the throttle body, and the gear wheel associated with the control motor meshes with the gear wheel associated with the throttle body.

13. The actuator unit of claim 4, wherein the wheel (12*a*) associated with the control motor is a gear wheel associated with the control motor, and the wheel (12*b*) associated with the throttle body is a gear wheel associated with the throttle body, and the gear wheel associated with the control motor meshes with the gear wheel associated with the throttle body.

14. The actuator unit of claim 5, wherein the wheel (12*a*) associated with the control motor is a gear wheel associated with the control motor, and the wheel (12*b*) associated with the throttle body is a gear wheel associated with the throttle body, and the gear wheel associated with the control motor meshes with the gear wheel associated with the throttle body.

15. The actuator unit of claim 1, wherein the wheel (12*a*) associated with the control motor and the wheel (12*b*)

associated with the throttle are in engagement with one another over a rolling path between the first engagement ends (e1 and E1) and the second engagement ends (e2 and E2); and wherein the wheel (12*a*) associated with the control motor and the wheel (12*b*) associated with the throttle body have rolling curve radii (r, R) that remain constant over a portion of the rolling path.

16. The actuator unit of claim 4, wherein the wheel (12*a*) associated with the control motor and the wheel (12*b*) associated with the throttle are in engagement with one another over a rolling path between the first engagement ends (e1 and E1) and the second engagement ends (e2 and E2); and wherein the wheel (12*a*) associated with the control motor and the wheel (12*b*) associated with the throttle body have rolling curve radii (r, R) that remain constant over a portion of the rolling path.

17. The actuator unit of claim 5, wherein the wheel (12*a*) associated with the control motor and the wheel (12*b*) associated with the throttle are in engagement with one another over a rolling path between the first engagement ends (e1 and E1) and the second engagement ends (e2 and E2); and wherein the wheel (12*a*) associated with the control motor and the wheel (12*b*) associated with the throttle body have rolling curve radii (r, R) that remain constant over a portion of the rolling path.

18. The actuator unit of claim 6, wherein the wheel (12*a*) associated with the control motor and the wheel (12*b*) associated with the throttle are in engagement with one another over a rolling path between the first engagement ends (e1 and E1) and the second engagement ends (e2 and E2); and wherein the wheel (12*a*) associated with the control motor and the wheel (12*b*) associated with the throttle body have rolling curve radii (r, R) that remain constant over a portion of the rolling path.

19. The actuator unit of claim 1, wherein the rolling curve radius (R) associated with the throttle body is longer at each engagement point than the rolling curve radius (r) associated with the control motor.

20. The actuator unit of claim 6, wherein the rolling curve radius (R) associated with the throttle body is longer at each engagement point than the rolling curve radius (r) associated with the control motor.

* * * * *